US008378919B2

(12) United States Patent
Yeh

(10) Patent No.: US 8,378,919 B2
(45) **Date of Patent: *Feb. 19, 2013**

(54) ANGLE ADJUSTMENT APPARATUS OF DISH ANTENNA AND DISH ANTENNA USING THE SAME

(75) Inventor: Chao Chun Yeh, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 621 days.

This patent is subject to a terminal disclaimer.

(21) Appl. No.: 12/648,733

(22) Filed: Dec. 29, 2009

(65) Prior Publication Data

US 2010/0177009 A1 Jul. 15, 2010

(30) Foreign Application Priority Data

Jan. 9, 2009 (TW) ..... 98114140 A

(51) Int. Cl.
*H01Q 3/02* (2006.01)
*H01Q 1/12* (2006.01)

(52) U.S. Cl. ..... 343/882; 343/892; 343/915

(58) Field of Classification Search ..... 343/878, 343/880, 882, 892, 915, 916
See application file for complete search history.

(56) References Cited

U.S. PATENT DOCUMENTS

| | | | | |
|---|---|---|---|---|
| 7,046,210 | B1 * | 5/2006 | Brooker et al. | 343/880 |
| 7,164,391 | B2 * | 1/2007 | Lin et al. | 343/882 |
| 2005/0052335 | A1 * | 3/2005 | Chen | 343/878 |

* cited by examiner

*Primary Examiner* — Robert Karacsony
(74) *Attorney, Agent, or Firm* — WPAT, P.C.; Anthony King

(57) ABSTRACT

An angle adjustment apparatus for a dish antenna comprises a base, a first rotating frame, a second rotating frame, and a second rotation angle adjustment mechanism. The first rotating frame is fixed to the base, and can relatively rotate around the base with a first rotating angle. The second rotating frame is fixed to the first rotating frame, and can relatively rotate around the first rotating frame with a second rotating angle. The second rotation angle adjustment mechanism comprises a first screw rod, a screw nut post, and a second screw rod. One end of the first screw rod is fixed to the first rotating frame, and the other end is equipped with first threads and engaged with the screw nut post. One end of the second screw rod pivots on the second rotating frame, and the other end is equipped with second threads and engaged with the screw nut post. The first threads and second threads have different screw directions, or have the same screw direction but with different thread pitches.

16 Claims, 4 Drawing Sheets

ANGLE ADJUSTMENT APPARATUS OF DISH ANTENNA AND DISH ANTENNA USING THE SAME

BACKGROUND OF THE INVENTION (A) Field of the Invention

The present invention is related to an angle adjustment apparatus of a dish antenna, and more specifically, to an adjustment apparatus for the fine tuning of the dish antenna angle using threads.

(B) Description of Related Art

A satellite television system employs a dish antenna to collect satellite signals, and the signals are then reflected to low noise block down converters (LNB) positioned at the focus of the dish antenna for amplifying the signals and reducing their frequencies down to around 1 GHz, i.e., the radio signals are transformed to an intermediate frequency. The adjusted signals are transmitted via a cable to an indoor television channel selector for selecting the signals of a desired channel, and the selected signals are then amplified, modulated and converted into video and audio signals for television viewing.

A dish antenna is a highly directional receiving device, which has to be precisely directed toward satellites in orbit at 36,000 kilometers altitude. For example, if a dish antenna with a 180 cm diameter shifts 2 cm horizontally, or 3 cm vertically, the signals will become weak or even disappear. In addition, if a dish antenna uses the Ka band, i.e., 26-40 GHz, an adjustment accuracy of 0.1 degrees is needed, and the tolerance has to be within 0.02 degrees for aiming at satellites precisely.

Normally, a dish antenna using the Ka band is adjusted by using a programmable logic controller (PLC) in control of servo motors; however, the high cost significantly limits its popularity.

FIG. 1 illustrates a known adjustable antenna apparatus 1 including a dish antenna 10, an LNB 11, a support rod 12, an adjustable dish bracket 13 and an adjustable base member 14. When the adjustable antenna apparatus 1 is disposed in different manners by securing the adjustable base member 14 at different places such as a vertical wall surface or a horizontal or inclined roof, the adjustable dish bracket 13 is used for adjusting the orientation of the dish antenna 10 to obtain optimal signal-reception performance. However, the adjustable dish bracket 13 only approximately adjusts the angle or fixing position of the dish antenna 10 according to the scale thereof, and obviously the dish antenna 10 cannot be fine-tuned within a precision smaller than the scale. In other words, the dish antenna 10 cannot be easily adjusted to an optimal angle or a fixing position.

SUMMARY OF THE INVENTION

The present invention provides an angle adjustment apparatus for a dish antenna. The angle adjustment apparatus utilizes threads to fine tune the orientation of the dish antenna. Therefore, the dish antenna can be precisely directed toward a transmitting satellite.

In accordance with an embodiment of the present invention, an angle adjustment apparatus for a dish antenna comprises a base, a first rotating frame, a second rotating frame, and a second rotation angle adjustment mechanism. The first rotating frame is fixed to the base, and can relatively rotate around the base with a first rotating angle. The second rotating frame is fixed to the first rotating frame, and can relatively rotate around the first rotating frame with a second rotating angle. The second rotation angle adjustment mechanism comprises a first screw rod, a screw nut post, and a second screw rod. One end of the first screw rod is fixed to the first rotating frame, and the other end is equipped with first threads and engaged with the screw nut post. One end of the second screw rod pivots on the second rotating frame, and the other end is equipped with second threads and engaged with the screw nut post. The first threads and second threads have different screw directions, or have the same screw direction but with different thread pitches.

In accordance with another embodiment of the present invention, a dish antenna apparatus comprises a dish, an angle adjustment apparatus, a support frame, and an adjustable stand. The dish is mounted on the angle adjustment apparatus, and the support frame connects the angle adjustment apparatus and the adjustable stand. The angle adjustment apparatus comprises a base, a first rotating frame, a second rotating frame, and a second rotation angle adjustment mechanism. The first rotating frame is fixed to the base, and can relatively rotate around the base with a first rotating angle. The second rotating frame is fixed to the first rotating frame, and can relatively rotate around the first rotating frame with a second rotating angle. The second rotation angle adjustment mechanism comprises a first screw rod, a screw nut post, and a second screw rod. One end of the first screw rod is fixed to the first rotating frame, and the other end is equipped with first threads and engaged with the screw nut post. One end of the second screw rod pivots on the second rotating frame, and the other end is equipped with second threads and engaged with the screw nut post. The first threads and second threads have different screw directions, or have the same screw direction but with different thread pitches.

DETAILED DESCRIPTION OF THE INVENTION

Figure 1:
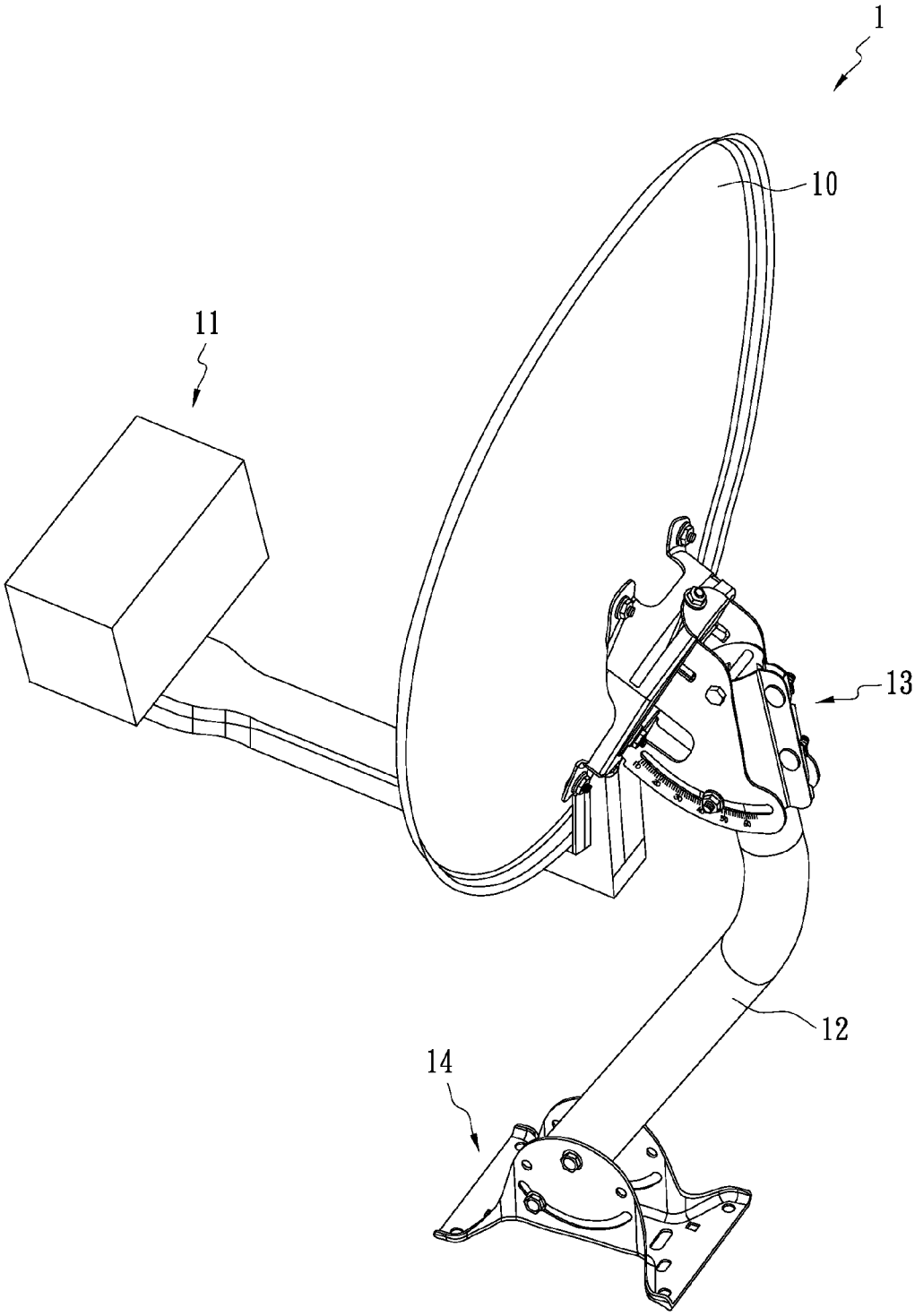
FIG. 1 (Prior Art)
FIG. 1 shows a known adjustable antenna apparatus.
Figure 2:
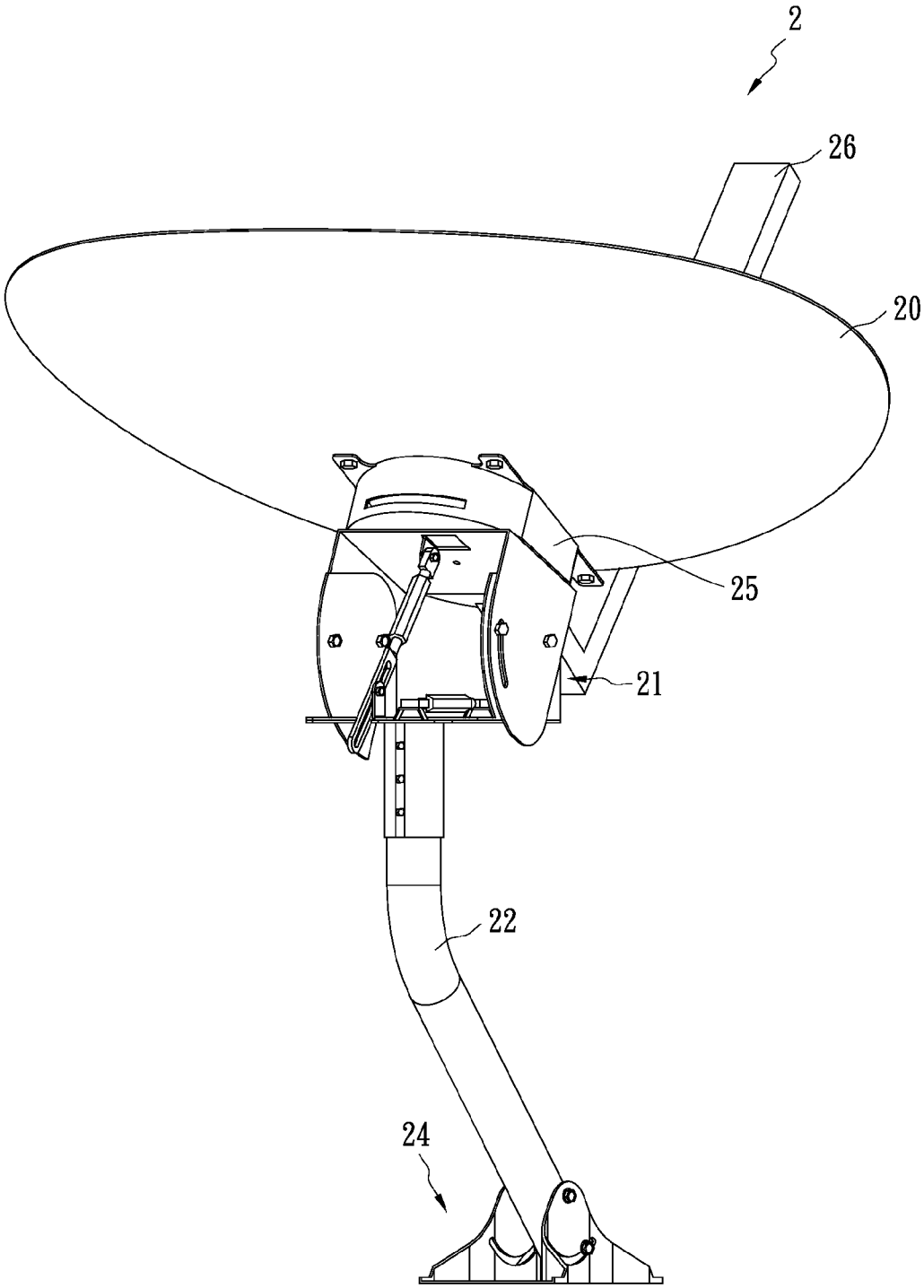
FIG. 2 shows a dish antenna apparatus in accordance with an embodiment of the present invention.

FIG. 2 shows a perspective view of a dish antenna apparatus according to an embodiment of the present invention. A dish antenna apparatus 2 includes a dish antenna 20, an angle adjustment apparatus 21, a support rod 22 and an adjustable base member 24. The dish antenna 20 is secured to the angle adjustment apparatus 21 by a dish bracket 25, and the angle adjustment apparatus 21 is configured to adjust the angles of the dish antenna 20 in two directions which are approximately perpendicular to each other. An LNB rod 26 is secured to a side of the dish bracket 25. The support rod 22 connects the angle adjustment apparatus 21 and the adjustable base member 24. The dish antenna apparatus 2 can be disposed in different manners by securing the adjustable base member 24 at different places such as a vertical wall surface or a horizontal or inclined roof, and the angle adjustment apparatus 21 can adjust the orientation of the dish antenna 20 for obtaining optimal transmission performance.

Figure 3:
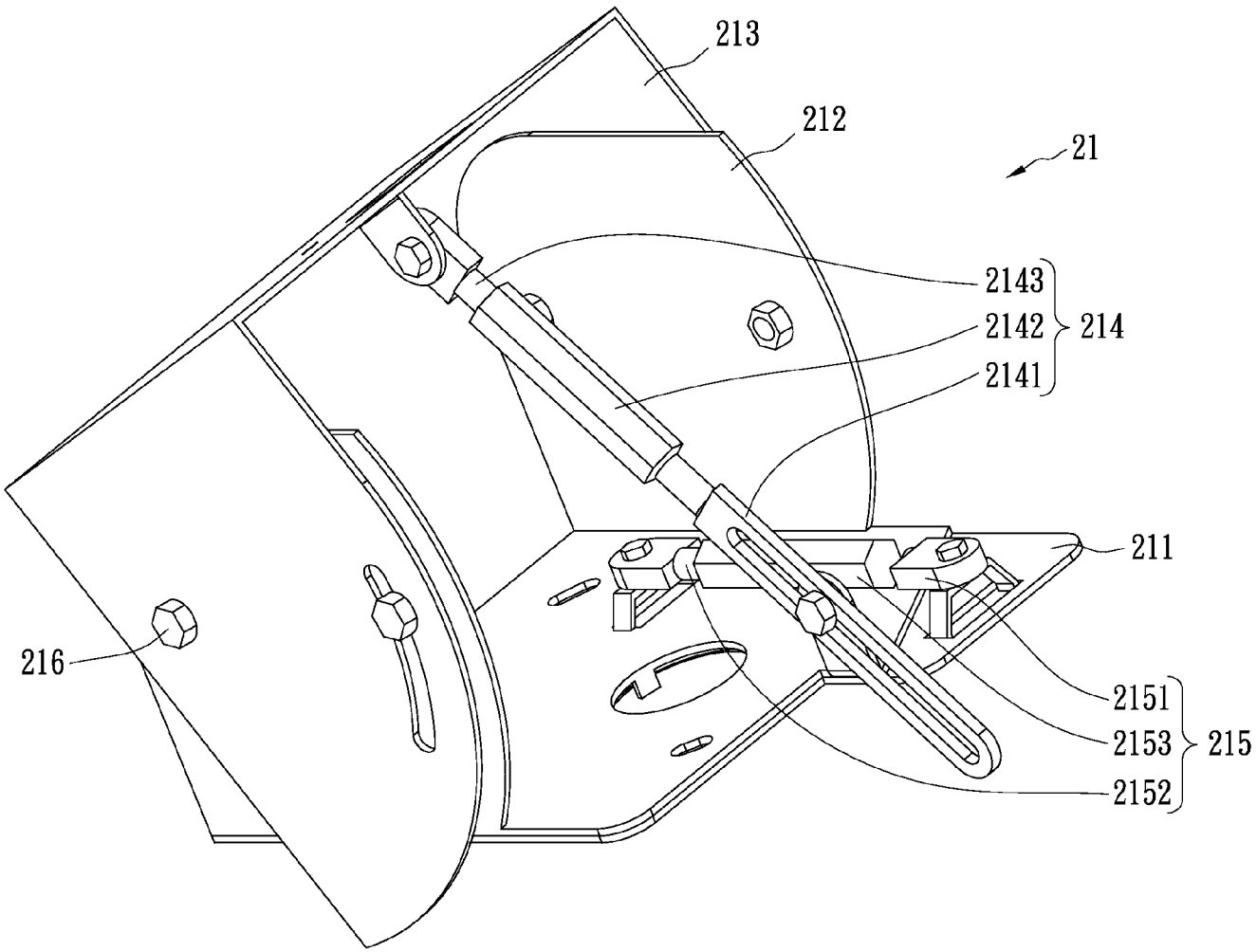
FIG. 3 shows an angle adjustment apparatus of the present invention.

FIG. 3 shows the perspective view of an angle adjustment apparatus in accordance with the present invention. The angle adjustment apparatus 21 includes a base member 211, a first rotation member 212, a second rotation member 213, a first rotating angle adjustment mechanism 215 and a second rotating angle adjustment mechanism 214. The first rotation member 212 is secured to the base member 211, and has a relative rotation movement around the base member 211 in a first rotation angle al. That is, the first rotation member 212 rotates along the direction perpendicular to the base member 211. The first rotating angle adjustment mechanism 215 comprises two screw rods (2151, 2152) and a screw nut post 2153. The two ends of the screw rods 2151 and 2152 are positioned apart from each other and respectively pivot on the base member 211 and the first rotation member 212. The two ends of the screw rods 2151 and 2152 are adjacent to each other and equipped with threads and connected to the screw nut post 2153 together.

Figure 4A:
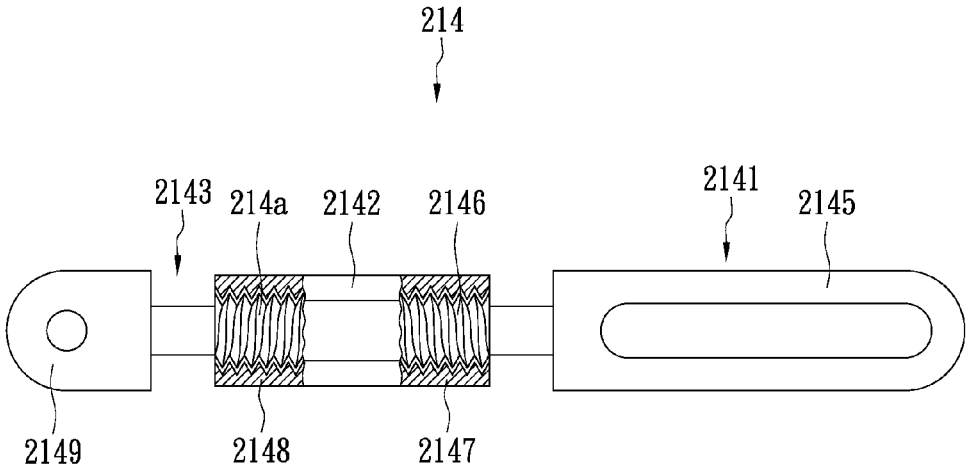
FIG. 4A shows a second rotating angle adjustment mechanism in accordance with the present invention.

The second rotation member 213 is secured to the first rotation member 212, and is capable of rotating by a first rotation angle $\alpha 2$ relative to the first rotation member 212. Referring to FIG. 4A, the second rotating angle adjustment mechanism 214 comprises a first screw rod 2141, a screw nut post 2142, and a second screw rod 2143. A fixed end 2145 of the first screw rod 2141 is fixed to the first rotating member 212, and the other end is equipped with first threads 2146 and engaged with the first inner threads 2147 of the screw nut post 2142. A fixed end 2149 of the second screw rod 2143 pivots on the second rotating frame 213, and the other fixed end is equipped with second threads 214*a* and engaged with the second inner threads 2148 of the screw nut post 2142. The first threads 2146 (or the first inner threads 2147) and the second threads 214*a* (or the second inner threads 2148) have different screw directions—left threads and right threads for example.

As the fixed end 2145 of the first screw rod 2141 is secured to the first rotation member 212, the relative angle between the first rotation member 212 and the second rotation member 213 can be fine tuned by rotating the screw nut post 2142. That is, because the screw directions of the first threads and second threads are different, the first screw rod 2141 and the second screw rod 2143 are simultaneously close to or away from the screw nut post 2142. Consequentially, the first rotation member 212 and the second rotation member 213 rotate around a pivotal axis 216 (as shown in FIG. 3) as a rotation center, and are separated or overlapped with each other.

Likewise, the screw rods 2151 and 2152 of the first rotating angle adjustment mechanism 215 and the screw nut post 2153 also have the same adjustment functions or analogous structures. The relative rotation movement starts between the first rotation member 212 and the base member 211 by rotating the screw nut post 2153 in a clockwise manner or in a counterclockwise manner. When the total length of the first rotating angle adjustment mechanism 215 is extended, the first rotation member 212 rotates counterclockwise around the base member 211. Alternatively, the first rotation member 212 rotates clockwise around the base member 211.

Figure 4B:
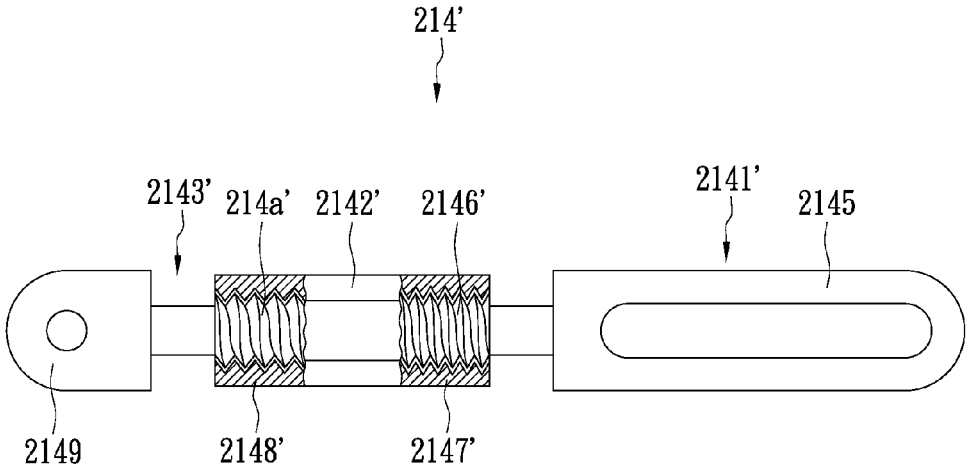
FIG. 4B shows another second rotating angle adjustment mechanism in accordance with the present invention.

FIG. 4B shows another second rotating angle adjustment mechanism in accordance with the present invention. The first threads 2146' and the second threads 214*a*' of the second rotating angle adjustment mechanism 214' have the same screw direction, but have different pitches. When the screw nut post 2142' is rotated, a relative movement starts between the first screw rod 2141' and the second screw rod 2143'. That is, the relative displacement speed between the first screw rod 2141' and the screw nut post 2142' is different from the relative displacement speed between the second screw rod 2143' and the screw nut post 2142'. The speed difference generates the mechanism of fine-tuning the second rotating angle $\alpha 2$.

The above-described embodiments of the present invention are intended to be illustrative only. Numerous alternative embodiments may be devised by those skilled in the art without departing from the scope of the following claims.

What is claimed is:

1. An angle adjustment apparatus for a dish antenna, comprising:
- a base;
- a first rotating frame fixed to the base and capable of relatively rotating around the base with a first rotating angle;
- a second rotating frame fixed to the first rotating frame and capable of relatively rotating around the first rotating frame with a second rotating angle; and
- a second rotation angle adjustment mechanism, comprising:
  - a screw nut post;
  - a first screw rod with one end pivotally fixed to the first rotating frame and the other end equipped with first threads and engaged with the screw nut post; and
  - a second screw rod with one end able to pivot on the second rotating frame and the other end equipped with second threads and engaged with the screw nut post;
  - wherein the first threads and second threads have different screw directions, or have the same screw direction but with different thread pitches.

2. The angle adjustment apparatus for a dish antenna of claim 1, further comprising a first rotation angle adjustment mechanism including two screw rods and a first rotation angle adjustment nut post, wherein two ends of the screw rods are positioned apart from each other and respectively pivot on the base member and the first rotation member and the other two ends of the screw rods are adjacent to each other and respectively equipped with different threads and connected to the first rotation angle adjustment nut post together.

3. The angle adjustment apparatus for a dish antenna of claim 2, wherein the threads of the two screw rods of the first rotation angle adjustment mechanism have different screw directions, or have the same screw direction but with different thread pitches.

4. The angle adjustment apparatus for a dish antenna of claim 1, wherein two ends of the screw nut post are respectively equipped with first inner threads and second inner threads, and the first inner threads and the second inner threads have different screw directions or have the same screw direction but with different thread pitches.

5. The angle adjustment apparatus for a dish antenna of claim 1, wherein the first rotation member and the second rotation member rotate around a pivotal axis to which they are pivotally fixed.

6. The angle adjustment apparatus for a dish antenna of claim 1, wherein the first threads are one of left threads and right threads, and the second threads are the other of left threads and right threads.

7. The angle adjustment apparatus for a dish antenna of claim 1, wherein the directions of the first rotation angle and the second rotation angle are substantially perpendicular to each other.

8. A dish antenna apparatus, comprising:
- an angle adjustment apparatus, comprising:
  - a base;
  - a first rotating frame fixed to the base and capable of relatively rotating around the base with a first rotating angle;

a second rotating frame fixed to the first rotating frame and capable of relatively rotating around the first rotating frame with a second rotating angle; and a second rotation angle adjustment mechanism, comprising:

a screw nut post;

a first screw rod with one end pivotally fixed to the first rotating frame and the other end equipped with first threads and engaged with the screw nut post; and a second screw rod with one end able to pivot on the second rotating frame and the other end equipped with second threads and engaged with the screw nut post;

wherein the first threads and second threads have different screw directions, or have the same screw direction but with different thread pitches a dish mounted on the angle adjustment apparatus;

an adjustable stand; and a support frame connecting the angle adjustment apparatus and the adjustable stand.

9. The dish antenna apparatus of claim 8, further comprising a first rotation angle adjustment mechanism including two screw rods and a first rotation angle adjustment nut post, wherein two ends of the screw rods are positioned apart from each other and respectively pivot on the base member and the first rotation member and the other two ends of the screw rods are adjacent to each other and respectively equipped with different threads and connected to the first rotation angle adjustment nut post together.

10. The dish antenna apparatus of claim 9, wherein the threads of the two screw rods of the first rotation angle adjustment mechanism have different screw directions, or have the same screw direction but with different thread pitches.

11. The dish antenna apparatus of claim 8, wherein the threads of the two screw rods of the first rotation angle adjustment mechanism have different screw directions, or have the same screw direction but with different thread pitches.

12. The dish antenna apparatus of claim 8, wherein the first rotation member and the second rotation member rotate about a pivotal axis to which they are pivotally fixed.

13. The dish antenna apparatus of claim 8, wherein the first threads are left threads and the second threads are right threads, or the first threads are right threads and the second threads are left threads.

14. The dish antenna apparatus of claim 8, wherein the first threads and the second threads are left threads with different thread pitches, or the first threads and the second threads are right threads with different thread pitches.

15. The dish antenna apparatus of claim 8, wherein the directions of the first rotation angle and the second rotation angle are substantially perpendicular to each other.

16. The dish antenna apparatus of claim 8, further comprising a dish bracket, wherein the dish antenna is secured to the angle adjustment apparatus.

* * * * *